US009994994B2

(12) United States Patent
Amils et al.

(10) Patent No.: US 9,994,994 B2
(45) Date of Patent: Jun. 12, 2018

(54) HYBRID ROPE

(71) Applicants: BRIDON INTERNATIONAL LTD., Doncaster, South Yorkshire (GB); DSM IP ASSETS B.V., Heeren (NL)

(72) Inventors: Xavier Amils, Kortrijk (BE); Beste Durmus, Sint-Denjis-Westrem (BE); Paulus Johannes Hyacinthus Marie Smeets, Geule (NL)

(73) Assignees: BRIDON INTERNATIONAL LTD., Doncaster (GB); DSM IP ASSETS B.V., Heerlen (NL)

( * ) Notice: Subject to any disclaimer, the term of this patent is extended or adjusted under 35 U.S.C. 154(b) by 457 days.

(21) Appl. No.: 14/433,325

(22) PCT Filed: Oct. 3, 2013

(86) PCT No.: PCT/EP2013/070635
§ 371 (c)(1),
(2) Date: Apr. 2, 2015

(87) PCT Pub. No.: WO2014/053601
PCT Pub. Date: Apr. 10, 2014

(65) Prior Publication Data

US 2015/0247285 A1 Sep. 3, 2015

(30) Foreign Application Priority Data

Oct. 5, 2012 (EP) ..... 12187343

(51) Int. Cl.
*D07B 1/06* (2006.01)
*D07B 1/00* (2006.01)
(Continued)

(52) U.S. Cl.
CPC ..... *D07B 1/0686* (2013.01); *D07B 1/005* (2013.01); *D07B 1/0693* (2013.01); *D07B 1/16* (2013.01);
(Continued)

(58) Field of Classification Search
CPC .... D07B 1/005; D07B 1/0686; D07B 1/0693; D07B 1/16; D07B 3/00
See application file for complete search history.

(56) References Cited

U.S. PATENT DOCUMENTS 4,034,547 A 7/1977 Loos
6,318,504 B1 11/2001 De Angelis
(Continued)

FOREIGN PATENT DOCUMENTS

DE 10 2007 024 020 A1 11/2008
EP 0 102 115 B1 6/1987
(Continued)

OTHER PUBLICATIONS

Encyclopedia of Polymer Science and Engineering, vol. 12, 1988, pp. 75-117.
(Continued)

*Primary Examiner* — Shaun R Hurley
(74) *Attorney, Agent, or Firm* — Foley & Lardner LLP

(57) ABSTRACT

Hybrid rope (20) comprising a core element (22) containing high modulus fibers surrounded by at least one outer layer (24) containing wirelike metallic members (26). The core element (22) is coated (23) with a thermoplastic polyurethane or a copolyester elastomer, preferably the copolyester elastomer containing soft blocks in the range of 10 to 70 wt %. The coated material (23) on the inner core element (22) is inhibited to be pressed out in-between the wirelike members (26) of the hybrid rope (20) and the hybrid rope (20) has decreased elongation and diameter reduction after being in use.

15 Claims, 3 Drawing Sheets

(51) Int. Cl.
*D07B 1/16* (2006.01)
*D07B 3/00* (2006.01)
*D07B 7/02* (2006.01)

(52) U.S. Cl.
CPC ..... *D07B 3/00* (2013.01); *D07B 7/025* (2013.01); *D07B 2201/108* (2013.01); *D07B 2201/1016* (2013.01); *D07B 2201/1036* (2013.01); *D07B 2201/203* (2013.01); *D07B 2201/204* (2013.01); *D07B 2201/2011* (2013.01); *D07B 2201/2019* (2013.01); *D07B 2201/2037* (2013.01); *D07B 2201/2055* (2013.01); *D07B 2201/2065* (2013.01); *D07B 2201/2068* (2013.01); *D07B 2201/2072* (2013.01); *D07B 2201/2074* (2013.01); *D07B 2201/2087* (2013.01); *D07B 2205/2003* (2013.01); *D07B 2205/205* (2013.01); *D07B 2205/2014* (2013.01); *D07B 2205/2039* (2013.01); *D07B 2205/2042* (2013.01); *D07B 2205/2064* (2013.01); *D07B 2205/2082* (2013.01); *D07B 2205/2096* (2013.01); *D07B 2401/201* (2013.01); *D07B 2501/2015* (2013.01)

(56) References Cited

U.S. PATENT DOCUMENTS

2006/0179813 A1* 8/2006 Vanneste ..... D02G 3/48 57/211
2007/0003780 A1* 1/2007 Varkey ..... H01B 7/2806 428/586
2009/0294009 A1* 12/2009 Barguet ..... D02G 3/48 152/527
2010/0101833 A1* 4/2010 Zachariades ..... B32B 5/26 174/136
2011/0197564 A1* 8/2011 Zachariades ..... B32B 5/26 57/210
2012/0175034 A1* 7/2012 Gauthier ..... D07B 1/0633 152/527
2012/0186715 A1* 7/2012 Toussain ..... B60C 9/0007 152/451
2013/0037353 A1* 2/2013 Phillips ..... B66B 7/06 187/254

FOREIGN PATENT DOCUMENTS

EP 0 357 883 A2 3/1990
EP 0 846 712 B1 5/2000
ES 2 203 293 A1 4/2004
JP 2000-178888 A 6/2000
WO WO 2011/154415 A1 12/2011
WO WO 2013/160139 A2 10/2013

OTHER PUBLICATIONS

Adams et al. Thermoplastic Polyether Ester Elastomers, Thermoplastic Elastomers, 2nd Edition, 1996, pp. 192-225.
Van Berkel et al., Polyester-Based Thermoplastic Elastomers, Handbook of Thermoplastics, 1997, pp. 397-415.
McKenna et al., Rope Structures, Handbook of Fibre Rope Technology, 2004, pp. 75-100.

* cited by examiner

HYBRID ROPE

TECHNICAL FIELD

The invention relates to a hybrid rope comprising a fiber core element and at least one metallic outer layer.

BACKGROUND ART

Common wire ropes and cables normally feature a metallic core surrounded by an outer layer of helically laid steel wire or wire strands. The cable with metallic core has a disadvantage of being exceedingly heavy in long lengths.

Therefore, ropes with a fiber core of natural or synthetic fibers twisted together with metallic wire strands, i.e. so called hybrid ropes, are introduced to impart various characteristics to the ropes depending on the type of natural or synthetic fibers used.

An advantage of a hybrid rope in view of a fully steel rope is the lower weight of the rope and improved performance like e.g. tension and bending fatigue.

The advantage of the hybrid rope in view of a fully fiber rope, e.g. nylon or polyester is that the hybrid rope is highly resistant to abrasion, crushing and stretch while also exhibiting the desired characteristics of toughness and excellent impact strength.

U.S. Pat. No. 4,034,547-A discloses a composite cable 10 which comprise a synthetic core 12 and a metal jacket 14 as illustrated in FIG. 1. The synthetic core 12 is formed of a bundle of low stretch fibers and the jacket 14 is formed of a plurality of wires or wire strands 16. This patent further discloses that a weight approximate 30% lighter than the weight of the corresponding size steel cable can be achieved by the composite cable.

The advantage of hybrid ropes comes into effect in particular in the case of ropes of great length for suspended use, such as hauling or hoisting operations, ropes in mining, cranes and elevators, aerial ropes or ropes for installations or use in marine and commercial fishing applications, and offshore applications like mooring, installation etc. This is because, during such use, the weight of rope by itself already takes up a large part of its load-bearing capacity and winch load capacity; the payload is correspondingly limited. Therefore, hybrid ropes are desirable in these operations since they provide comparable performance with steel ropes and lower weight expanding the possibilities, e.g. mooring deeper in the water.

On the other hand, however, hybrid ropes having nylon or polyester core do not have high breaking loads, therefore cannot be used where high strength as in case of full steel ropes is required. In such case hybrids with high modulus fibers as core can be used.

It however has the drawback of requiring important modifications relative to more conventional cables as to its use and control. For example, the fiber core is relatively easy to be abraded due to its movement relative to the steel outer layer when the rope is in use. Very recently, international patent application WO-2011/154415-A1 discloses using the coating of plastomer on the high modulus polyethylene (HMPE) core to protect the HMPE core against abrasion due to the movement of the steel wire strands. Moreover, less slippage occurs between the core and the steel outer layer.

However, for critical applications, where huge compressive stresses are created in the rope either from high applied loads, crushing in a winch or a drum winder or when very low bending radius is applied, for instance in conditions $D/d \leq 30$ (where D represents the diameter of pulley and d is the diameter of the rope) and $SF \leq 5$ (SF is an abbreviation of safety factor), it is found the extruded plastomer is not sufficient to protect the core and the plastomer may deteriorate and will be pressed out between the steel wire strands to the outer rope surface after being used for certain time.

DISCLOSURE OF INVENTION

It is a main object of the present invention to develop a hybrid rope in particular suitable for critical applications, e.g. resulting in high stresses or applying low bending radius.

It is another object of the present invention to devise a hybrid rope having considerably increase resistance to fatigue and can avoid pressing out a coated material on an inner core in-between the wirelike members after the hybrid rope being in use for many cycles and the method to produce thereof.

According to a first aspect of the present invention, there is provided a hybrid rope comprising a core element containing high modulus fibers surrounded by at least one outer layer containing wirelike metallic members, wherein the core element is coated with a polymer having copolyester elastomer or thermoplastic polyurethane (TPU).

Thermoplastic polyurethane may be formed by the reaction between diisocyanates, short chain diols or diamines (hard blocks) and long chain diols or diamines (soft blocks). Hard blocks preferably have been formed by the reaction between 4,4"-diphenylmethane diisocyanate (MDI) and a short chain diol, for example ethylene glycol, 1,4-butanediol, and 1,4-di-β-hydroxyethoxybenzene. The soft blocks preferably originate from a long chain polyester diol or a polyether diol, preferably a long chain polyether diol. The molecular weight (Mn) of the long chain diols may be between 600 and 6000.

Both ether-based and ester-based TPU's exist, with both having a specific set of advantages: ether based grades have better hydrolysis and microbial resistance, ester based have the best mechanical properties and heat resistance. Both type of TPU's may be used in the present application. As an example, BASF Elastollan® 1160D Polyether Type Polyurethane Elastomer may be extruded on the core of the hybrid rope.

Alternatively, the core element is coated with a polymer having copolyester elastomer containing soft blocks in the range of 10 to 70 wt %. Preferably, the hardness Shore D of the copolyester elastomer as measured according to ISO 868 is larger than 50. In a preferred embodiment, the copolyester elastomer contains soft blocks in the range of 10 to 40 wt %. In a more preferred embodiment, the copolyester elastomer contains soft blocks in the range of 20 to 30 wt %. In a most preferred embodiment, the copolyester elastomer contains 25 wt % soft blocks. The modulus and the hardness of the copolyester elastomer depend on the type and concentration of soft blocks in the copolyester elastomer. The advantage of using the copolyester elastomer containing soft and hard blocks in the manufacture of the hybrid rope is that a hard transition layer established in-between the core and the outer metallic layer. Less concentration of soft blocks in the copolyester elastomer can make the elastomer harder. Thus, the application of copolyester elastomer transition layer between the core and outer metallic layer improves the fatigue resistance of the hybrid rope and avoids the flowing of the coated copolyester elastomer (transition layer) due to the fretting when the hybrid rope is in use. Furthermore, the copolyester elastomer containing soft blocks is compatible with the inner fiber core element and the outer metallic layer.

Also, the material has out-standing resistance to flexural and bending fatigue both at high temperatures and sub-zero temperatures. This makes it particular suitable for applications such as crane ropes, which are subjected to a wide range of temperatures and also encounter very high levels of flexural fatigue and compression.

Suitably, the copolyester elastomer is a copolyesterester elastomer, a copolycarbonateester elastomer, and/or a copolyetherester elastomer; i.e. a copolyester block copolymer with soft blocks consisting of segments of polyester, polycarbonate or, respectively, polyether. Suitable copolyesterester elastomers are described, for example, in EP-0102115-B1. Suitable copolycarbonateester elastomers are described, for example, in EP-0846712-B1. Copolyester elastomers are available, for example, under the trade name Arnitel®, from DSM Engineering Plastics B.V. The Netherlands.

Preferably copolyester elastomer is a copolyetherester elastomer.

Copolyetherester elastomers have soft segments derived from at least one polyalkylene oxide glycol. Copolyetherester elastomers and the preparation and properties thereof are in the art and for example described in detail in Thermoplastic Elastomers, 2nd Ed., Chapter 8, Carl Hanser Verlag (1996) ISBN 1-56990-205-4, Handbook of Thermoplastics, Ed. O. Otabisi, Chapter 17, Marcel Dekker Inc., New York 1997, ISBN 0-8247-9797-3, and the Encyclopedia of Polymer Science and Engineering, Vol. 12, pp. 75-117 (1988), John Wiley and Sons, and the references mentioned therein.

The aromatic dicarboxylic acid in the hard blocks of the polyetherester elastomer suitably is selected from the group consisting of terephthalic acid, isophthalic acid, phthalic acid, 2,6-naphthalenedicarboxylic acid and 4,4-diphenyldicarboxylic acid, and mixtures thereof. Preferably, the aromatic dicarboxylic acid comprises terephthalic acid, more preferably consists for at least 50 mole %, still more preferably at least 90 mole %, or even fully consists of terephthalic acid, relative to the total molar amount of dicarboxylic acid.

The alkylene diol in the hard blocks of the polyetherester elastomer suitably is selected from the group consisting of ethylene glycol, propylene glycol, butylene glycol, 1,2-hexane diol, 1,6-hexamethylene diol, 1,4-butane diol, benzene dimethanol, cyclohexane diol, cyclohexane dimethanol, and mixtures thereof. Preferably, the alkylene diol comprises ethylene glycol and/or 1,4 butane diol, more preferably consists for at least 50 mole %, still more preferably at least 90 mole %, or even fully consists of ethylene glycol and/or 1,4 butane diol, relative to the total molar amount of alkylene diol.

The hard blocks of the polyetherester elastomer most preferably comprise or even consist of polybutylene terephthalate segments.

Suitably, the polyalkylene oxide glycol is a homopolymer or copolymer on the basis of oxiranes, oxetanes and/or oxolanes. Examples of suitable oxiranes, where upon the polyalkylene oxide glycol may be based, are ethylene oxide and propylene oxide. The corresponding polyalkylene oxide glycol homopolymers are known by the names polyethylene glycol, polyethylene oxide, or polyethylene oxide glycol (also abbreviated as PEG or pEO), and polypropylene glycol, polypropylene oxide or polypropylene oxide glycol (also abbreviated as PPG or pPO), respectively. An example of a suitable oxetane, where upon the polyalkylene oxide glycol may be based, is 1,3-propanediol. The corresponding polyalkylene oxide glycol homopolymer is known by the name of poly(trimethylene)glycol. An example of a suitable oxolane, where upon the polyalkylene oxide glycol may be based, is tetrahydrofuran. The corresponding polyalkylene oxide glycol homopolymer is known by the name of poly (tretramethylene)glycol (PTMG) or polytetrahydrofuran (PTHF). The polyalkylene oxide glycol copolymer can be random copolymers, block copolymers or mixed structures thereof. Suitable copolymers are, for example, ethylene oxide/polypropylene oxide block-copolymers, (or EO/PO block copolymer), in particular ethylene-oxide-terminated polypropylene oxide glycol.

The polyalkylene oxide can also be based on the etherification product of alkylene diols or mixtures of alkylene diols or low molecular weight poly alkylene oxide glycol or mixtures of the aforementioned glycols.

Preferably, the polyalkylene oxide glycol used is poly (tretramethylene)-glycol (PTMG).

The core element is preferably a rope made of synthetic fibers. The core may preferably have any construction known for synthetic ropes. The core may have a plaited, a braided, a laid, a twisted or a parallel construction, or combinations thereof. Preferably the core has a laid or a braided construction, or a combination thereof.

In such rope constructions, the ropes are made up of strands. The strands are made up of rope yarns, which contain synthetic fibers. Methods of forming yarns from fiber, strands from yarn and ropes from strands are known in the art. Strands themselves may also have a plaited, braided, laid, twisted or parallel construction, or a combination thereof.

In addition, the rope can be preconditioned before further processing through e.g. pre-stretching, annealing, heat setting or compacting the rope. The constructional elongation can also be removed during the hybrid rope production by sufficiently pre-tensioning the core before applying a coating like the discussed extruded polymer jacket or braided or laid cover or during closing the outer wire strands onto the core.

The application of the coating of the present application on the core of hybrid ropes may avoid a synthetic fiber or fabric sheathing which is used to enclose the core in some applications.

For a further description of rope constructions, see for example "Handbook of fibre rope technology", McKenna, Hearle and O'Hear, 2004, ISBN 0-8493-2588-9.

Synthetic yarns that may be used as the core of the hybrid rope according to the invention include all yarns, which are known for their use in fully synthetic ropes. Such yarns may include yarns made of fibers of polypropylene, nylon, polyester. Preferably, yarns of high modulus fibers are used, for example yarns of fibers of liquid crystal polymer (LCP), aramid such as poly(p-phenylene terephthalamide) (known as Kevlar®), high molecular weight polyethylene (HMwPE), ultra-high molecular weight polyethylene (UHMwPE) such as Dyneema® and PBO (poly(p-phenylene-2,6-benzobisoxazole). The high modulus fibers preferably have a break strength of at least 2 MPa and tensile modulus preferably above 100 GPa. The diameter of the core element may vary between 2 mm to 300 mm.

The advantage of using high modulus fibers in the rope over other fiber is that high modulus fibers exceeds in terms of properties like tension fatigue, bending fatigue and stiffness and high modulus fibers has the better match with steel wire.

The polymer having copolyester elastomer may be applied on the core element by any available coating method. Preferably, the polymer is coated on the core element by extrusion. The thickness of the coated copolyester elastomer is in the range of 0.1 to 5 mm. Preferably, the thickness is larger than 0.5 mm.

Importantly, even though copolyester elastomer e.g. Arnitel® is applied with high temperature on high modulus fibers e.g. Dyneema® core, the breaking load of the hybrid rope is high and Dyneema® core is not damaged with this applied high temperature (up to 230° C.).

As an example, table 1 gives the breaking load (BL) of 3 hybrid ropes (2 extruded, 1 not extruded) and one reference rope. Additionally, modulus and BL efficiency are also given. In comparison, the high modulus fibers Dyneema® core is either extruded with Arnitel® or with polypropylene (PP). The tensile modulus of the applied type of PP is 1450 MPa (ISO 527-1, -2) and Charpy notched impact strength at 0° C., Type 1, Edgewise is larger than 7 kJ/m$^2$ (ISO 179). The melt flow rate (MFR) (230° C./2.16 Kg) of PP as per ISO1133 is 1.3 g/10 min.

The BL of hybrid ropes is very high (around 13% higher than reference rope). The BL of hybrid rope that the cores with extrusion and without extrusion are within the same range which shows that extruding in high temperature did not results in loss of strength in Dyneema® core. The BL efficiency is also an indication of that. BL efficiency is defined as a ratio of "measured BL" to "BL of steel wires× number of steel wires+BL of core". It describes the loss of BL due to spinning of wire strands and anything that can cause a BL decrease in the core. As shown in table 1, the BL efficiency of hybrid rope with extruded and non-extruded core is quite comparable, which indicates the Dyneema® core did not lose its BL in extruded hybrid ropes even though extrusion is applied at high temperatures.

TABLE 1

Properties of hybrid ropes in comparison.

| Rope | Diameter (mm) at 17.6 kgf | Linear Weight (kg/m) | Breaking Load (tons) | BL Efficiency (%) | Modulus (GPa) |
|---|---|---|---|---|---|
| 11 mm Dyneema ® core extruded with Arnitel ® | 26.85 | 2.69 | 52.37 | 78.9% | 89.81 |
| 11 mm Dyneema ® core extruded with PP | 26.85 | 2.75 | 52.17 | 78.6% | 87.98 |
| 13 mm Dyneema ® core non-extruded | 26.60 | 2.60 | 53.96 | 76.2% | 93.00 |
| 13 mm PP core (reference rope) | 26.15 | 2.75 | 46.07 | 83.3% | 76.00 |

According to the present invention, it is still possible to add an additional plastomer layer in-between the core element and the coated polymer having copolyester elastomer containing soft blocks in the range of 10 to 70 wt %. An additional plastomer layer may also be added in-between the two or more outer layers. The plastomer may be a semi-crystalline copolymer of ethylene or propylene and one or more C2 to C12 α-olefin co-monomers and have a density as measured according to ISO1183 of between 870 and 930 kg/m$^3$. Suitable plastomers that may be used in the invention are manufactured on a commercial scale, e.g by Exxon, Mitsui, DEX-Plastomers and DOW under brand names as Exact®, Tafmer, Exceed, Engage, Affinity, Vistamaxx and Versify. The advantage of using the above-mentioned plastomer in the manufacture of this hybrid rope is that the plastomer has a processing temperature such that the mechanical properties of the fiber core are not adversely effected by the processing conditions. Furthermore, since the plastomer is also based on polyolefin a good adhesion between the plastomer and fiber core can be achieved when required. Also a uniform layer thickness of the coating can be obtained, ensuring a better closing of the steel wire around the core. Using the coating of the plastomer of the invention on the fiber core in the hybrid rope also ensures that the fiber core is protected against abrasion due to the movement of the metallic wirelike members when the rope is in use. Less slippage occurs between the core and the metallic wirelike members in the outer layer.

On top of this plastomer layer, a second or more polymer layers can be applied, the polymer having copolyester elastomer containing soft blocks in the range of 10 to 70 wt %. The coated polymer layers make the hybrid rope stiffer and less fluid, and provide better fatigue, abrasion and chemical resistance etc. The application of two or more coated layers on the fiber core can be implemented in some common ways, e.g. co-extrusion or step extrusion etc.

Herewith, the hybrid rope has a diameter in the range of 2 to 400 mm, e.g. 10 mm, 50 mm, 100 mm and 200 mm.

As an example, the wirelike metallic members are steel wires and/or steel wire strands. The wires of the rope may be made of high-carbon steel. A high-carbon steel has a steel composition as follows: a carbon content ranging from 0.5% to 1.15%, a manganese content ranging from 0.10% to 1.10%, a silicon content ranging from 0.10% to 1.30%, sulfur and phosphorous contents being limited to 0.15%, preferably to 0.10% or even lower; additional micro-alloying elements such as chromium (up to 0.20%-0.40%), copper (up to 0.20%) and vanadium (up to 0.30%) may be added. All percentages are percentages by weight.

Preferably, the steel wires and/or steel wire strands of at least one metallic layer are coated individually with zinc and/or zinc alloy. More preferably, the coating is formed on the surface of the steel wire by galvanizing process. A zinc aluminum coating has a better overall corrosion resistance than zinc. In contrast with zinc, the zinc aluminum coating is more temperature resistant. Still in contrast with zinc, there is no flaking with the zinc aluminum alloy when exposed to high temperatures. A zinc aluminum coating may have an aluminum content ranging from 2 wt % to 12 wt %, e.g. ranging from 5% to 10%. A preferable composition lies around the eutectoid position: aluminum about 5 wt %. The zinc alloy coating may further have a wetting agent such as lanthanum or cerium in an amount less than 0.1 wt % of the zinc alloy. The remainder of the coating is zinc and unavoidable impurities. Another preferable composition contains about 10% aluminum. This increased amount of aluminum provides a better corrosion protection than the eutectoid composition with about 5 wt % of aluminum. Other elements such as silicon and magnesium may be added to the zinc aluminum coating. More preferably, with a view to optimizing the corrosion resistance, a particular good alloy comprises 2% to 10% aluminum and 0.2% to 3.0% magnesium, the remainder being zinc.

The hybrid rope according to the invention contains at least one outer layer containing wirelike metallic members. Thus, the hybrid rope may contain two outer layers containing wirelike metallic members. As an example, the diameter of the first wirelike members in the first outer layer is different from the diameter of the second wirelike members in the second outer layer. In another example, the diameter of the first wirelike members is equal to the diameter of the second wirelike members. The diameter of the wirelike members may vary between 0.30 mm to 30 mm. Preferably, the first twist direction of the first metallic layer and the second twist direction of the second metallic layer are different lay directions. It may further comprises a step of preforming each of the wirelike members to set a predetermined helical twist prior to twisting. As an example, the first metallic layer is twisted in "S" direction and the second metallic layer is twisted in "Z" direction. As another example, the first metallic layer is twisted in "Z" direction and the second metallic layer is twisted in "S" direction. The "S" and "Z" torque is balanced and therefore the hybrid rope is non-rotating.

In addition, the outer layer containing wirelike metallic members may comprise hybrid strands or steel strands. The hybrid strand contains a synthetic core and outer wirelike filaments. In each steel strand, the wire filaments could have same or different diameters.

The hybrid rope may further comprises a jacket surrounding the metallic outer layer. In case of a hybrid rope having more than one metallic outer layer, a jacket may also be applied in between the metallic outer layers. The jacket comprises a plastomer, thermoplastic and/or elastomer coated or extruded on the metallic layer according to the invention. The coating has an average thickness of at least 0.1 mm, more preferably at least 0.5 mm. Said thickness is at most 50 mm, preferably at most 30 mm, more preferably at most 10 mm and most preferably at most 3 mm.

According to a second aspect of the invention, there is provided a method to decrease elongation and diameter reduction and increase lifetime of a hybrid rope after being in use when taking as a reference a hybrid rope without coating or with other coatings such as PP on the core. Said method comprises the steps of (a) providing a core element, wherein said core element includes high modulus fibers; (b) coating said core element with a polymer having copolyester elastomer containing soft blocks in the range of 10 to 70 wt %; and (c) twisting a plurality of wirelike metallic members together around the core element to form a metallic outer layer.

According to a third aspect of the invention, there is provided a method to avoid pressing out a coated material on an inner core in-between the wirelike members of a hybrid rope after being in use. Said method comprises the steps of (a) providing a core element, wherein said core element includes high modulus fibers; (b) coating said core element with a polymer having copolyester elastomer containing soft blocks in the range of 10 to 70 wt %; and (c) twisting a plurality of wirelike metallic members together around the core element to form a metallic outer layer.

The invention illustratively described herein may suitably be practiced in the absence of any element or elements, limitation or limitations, not specifically disclosed herein. Thus, for example, the terms "comprising", "including", "containing", etc. shall be read expansively and without limitation. Additionally, the terms and expressions employed herein have been used as terms of description and not of limitation, and there is no intention in the use of such terms and expressions of excluding any equivalents of the features shown and described or portions thereof, but it is recognized that various modifications are possible within the scope of the invention claimed.

BRIEF DESCRIPTION OF FIGURES IN THE DRAWINGS

The invention will be better understood with reference to the detailed description when considered in conjunction with the non-limiting examples and the accompanying drawings, in which.

MODE(S) FOR CARRYING OUT THE INVENTION

Hybrid Rope 1

Figure 1:
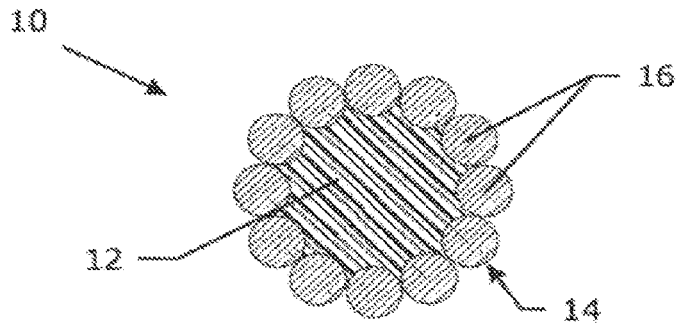
PRIOR ART Fig. 1
FIG. 1 is a cross-section of a prior art hybrid rope.
Figure 2:
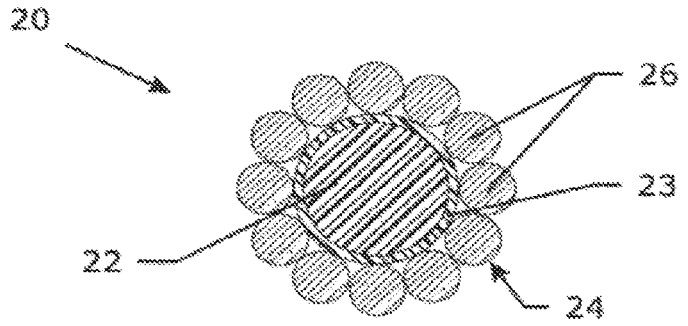
FIG. 2 is a cross-section of a hybrid rope according to a first embodiment of invention.

FIG. 2 is a cross-section of an invention hybrid rope according to a first embodiment of the invention. The invention hybrid rope 20 comprises a fiber core 22, a coated polymer layer 23, and an outer layer 24 containing metallic wirelike members 26. The hybrid rope 20 as illustrated in FIG. 2 has a "12+FC" rope construction. The term "12+FC" refers to a rope design with a metallic outer layer having 12 single wires and a fiber core (abbreviated as FC).

The core 22 is made of a plurality of high modulus polyethylene (HMPE) yarns, e.g. any one or more of 8*1760 dTex Dyneema® SK78 yarn, 4*1760 dTex Dyneema® yarn or 14*1760 dTex Dyneema® 1760 dTex SK78 yarn. The core 22 can be made of a bundle of continuous synthetic yarns or braided strands. As an example, in a first step a 12 strand braided first core part was produced, each strand consisting of 8*1760 dTex Dyneema® SK78 yarn. This first core part is overbraided with 12 strands of 4*1760 dTex Dyneema® yarn.

In a next step the coated layer 23 of copolyester elastomer, such as Arnitel®, is extruded on the core 22 as produced above using a conventional single screw extruder with the processing conditions described in the user extrusion guidelines.

Thereafter, the hybrid rope is obtained by twisting twelve steel wires around the core 22. In this embodiment, the metallic wirelike members 26 as an example illustrated herewith are identical single steel wires.

Alternatively, it should be understood that the metallic wirelike members 26 may be metallic strands comprising several filaments. It should be understood that the metallic outer layer 24 may also comprise a combination of filament strands and single steel wires.

It should be noted that in the coated polymer layer 23 in FIG. 2 (similarly also for the coated polymer layers in the following figures) looks round but in reality it's star shaped and goes in between the strands.

Hybrid Rope 2

Figure 3:
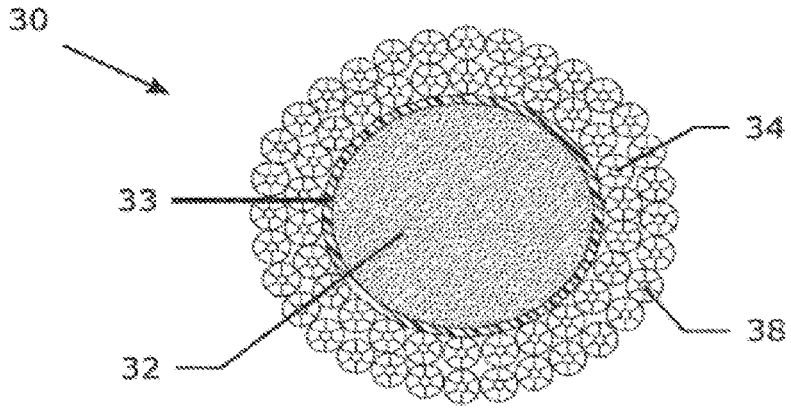
FIG. 3 is a cross-section of a hybrid rope according to a second embodiment of invention.

FIG. 3 is a cross-section of an invention hybrid rope according to a second embodiment of the invention. The invention hybrid rope 30 comprises a fiber core 32, an extruded copolyester elastomer layer 33 having copolyester elastomer containing soft blocks in the range of 10 to 70 wt %, a first metallic outer layer containing first metallic wirelike members 34 and a second metallic outer layer containing second metallic wirelike members 38. The hybrid rope 30 as illustrated in FIG. 3 has a "32×7c+26×7c+FC SsZs, SzZz or ZzSz" rope construction. The term "32×7c+26×7c+FC SsZs" refers to a rope design with the second metallic layer (most outside layer) having 32 strands (i.e. second metallic wirelike members 38) with a rotating direction of "S", wherein each strand contains 7 compacted filaments with a rotating direction of "s", the first metallic layer having 26 strands (i.e. first metallic wirelike members 34) with a rotating direction of "Z", wherein each strand contains 7 compacted filaments with a rotating direction of "s", and a fiber core (abbreviated as FC). The metallic members 34, 38 of the hybrid rope 30 as shown in FIG. 3 have an identical dimension and filament strand constructions. Alternatively, the metallic members may have different diameter and/or the other filament strand constructions.

Hybrid Rope 3

Figure 4:
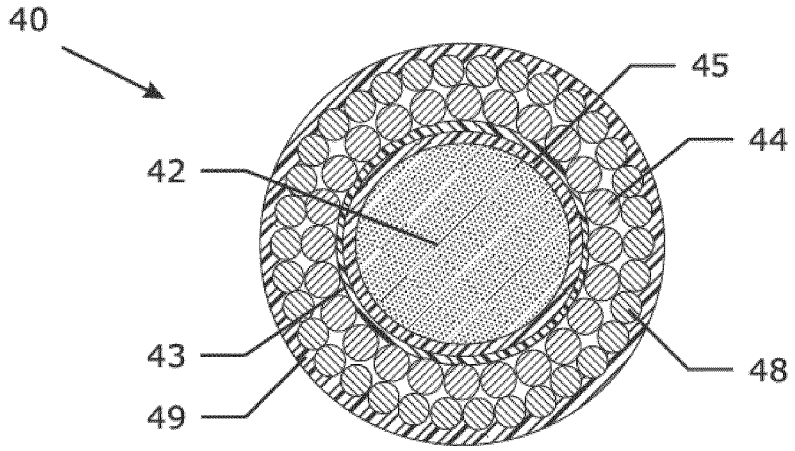
FIG. 4 is a cross-section of a hybrid rope according to a third embodiment of invention.

FIG. 4 is a cross-section of an invention hybrid rope according to a third embodiment of the invention. As an example, the illustrated hybrid rope 40 has a construction of "34+24+FC SZ". The invention hybrid rope 40 comprises a fiber core 42, an extruded copolyester elastomer layer 43 such as Arnitel® around the core 42, a first metallic outer layer containing first metallic wirelike members 44. In addition, an extruded plastomer layer 45, such as EXACT® 0230 is coated in-between the fiber core 42 and the extruded copolyester elastomer layer 43. A second metallic outer layer containing second metallic wirelike members 48 twisted in different direction of the first metallic wirelike members 44 is on top of the first metallic outer layer and a thermoplastic protection layer 49, such as polyethylene (PE) is extruded on the entire rope. Optionally, an additional coating/extruded layer, such as polyethylene (PE), can be added in between the two metallic layers to avoid fretting in between the metallic layers.

Hybrid Rope 4

Figure 5:
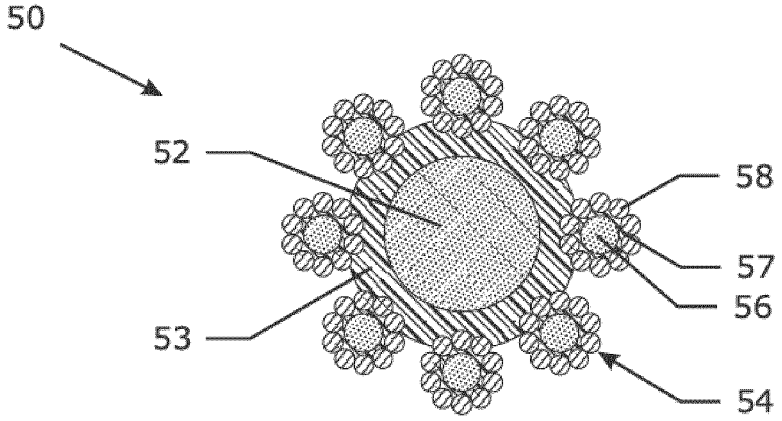
FIG. 5 is a cross-section of a hybrid rope according to a fourth embodiment of invention.

FIG. 5 is a cross-section of an invention hybrid rope according to a fourth embodiment of the invention. As an example, the illustrated invention hybrid rope 50 comprises a fiber core 52, an extruded copolyester elastomer layer 53 around the core 52, and an outer layer 54 containing hybrid strands. Herein, the hybrid strand contains a fiber core 56, an optional extruded layer 57 and a metallic layer containing metallic wirelike members 58 around the extruded layer 57. The composition of the fiber core 56 in the outer layer may be the same as or different from that of the fiber core 52 in the central of the hybrid rope. The composition of the extruded layer 57 on the individual hybrid strand may also be the same as or different from that of the extruded layer 53 on the fiber core 52 of the hybrid rope. The metallic wirelike members 58 are preferably galvanized steel wires.

Test Comparisons

Figure 6:
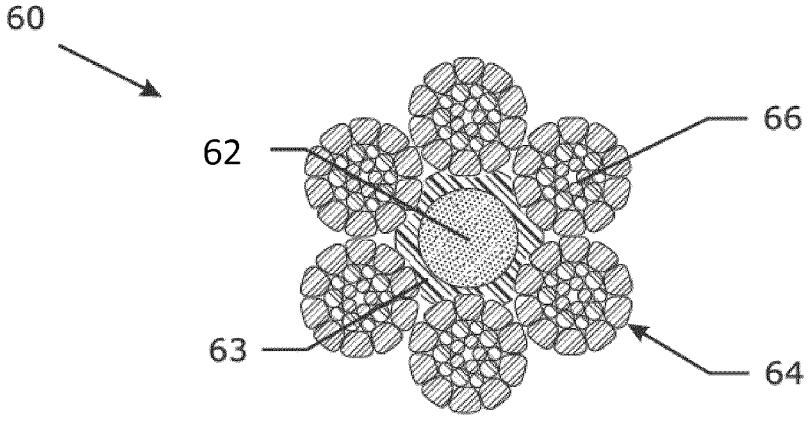
FIG. 6 is a cross-section of a hybrid rope according to the invention in test comparison.

The advantage of present invention will be illustrated after comparison. The invention hybrid rope 60 having a rope construction as shown in FIG. 6 is produced for comparison. A fiber core 62 is enclosed by an extruded layer 63. An outer metallic layer 64 containing six steel strands 66 are around the extruded core. In each strand 66, there is 26 steel wires. The 6 strands 66 are compacted with the extruded fiber core and thus a 26 mm hybrid rope is formed. The detailed dimension of the hybrid rope is given in table 2. According to the invention, in this specific example, the core element is high modulus fiber, Dyneema®, with a diameter of 11 mm. The core is extruded with a copolyester elastomer containing soft blocks, Arnitel®, with a thickness of 1 mm.

TABLE 2

Rope dimension of the invention rope in comparison.
Hybrid Rope: 6 × 26WS C + FC

| | |
|---|---|
| Rope diameter after strand compaction (mm) | 26 |
| Core diameter (mm) | 11 |
| Extruded layer thickness (mm) | 1 |

TABLE 2-continued

Rope dimension of the invention rope in comparison.
Hybrid Rope: 6 × 26WS C + FC

| | | |
|---|---|---|
| Outer strand diameter (8.54 mm) | Central (mm) | 0.84 |
| | Interior (mm) | 1.17 |
| | Warrington 2 (mm) | 1.41 |
| | Warrington 1 (mm) | 1.11 |
| | Exterior (mm) | 2.00 |

In order to give an explicit indication, a conventional hybrid rope having the same rope configuration and similar dimension is taken as a reference hybrid rope, wherein a polypropylene (PP) core having a core diameter of 13 mm without extruded layer is compacted directly with steel strands. The invention hybrid rope having Dyneema® core extruded with Arnitel® is compared therewith.

Also for comparison, a hybrid rope having an identical Dyneema® core extruded with PP at a same thickness, i.e. 1 mm, is taken as a comparative example.

Because of the great responsibility involved in ensuring being safely rigged on equipment, any wire rope in use must be clearly under its breaking load. The use of safety factor (SF) is imposed by law or standard to which a structure must conform or exceed. SF is a ratio of breaking load (absolute strength) to actual applied load, i.e.

$$SF = \frac{\text{Breaking_load}}{\text{Applied_load}} \tag{1}$$

The purpose to impose SF is to maintain the rope in the service life and strength within the limits of safety.

The condition of pulley, drum or sheaves and other end fittings should be noted also. The condition of these parts affects rope wear: the smaller the bend radius of pulley, the greater the bending resistance. The hybrid ropes are tested in bending and fatigue tests performed in a severe condition, where pulley size D=514 mm, and the diameter of the rope d=26 mm i.e. D/d≈20.

Ropes Loaded at the Same Load:

The properties, such as linear weight, breaking load, applied load and modulus, of the investigated hybrid ropes are illustrated in table 3.

As shown in table 3, the linear weight of all the hybrid ropes is comparable, while the breaking load and modulus of the hybrid ropes with extruded Dyneema® core (D2) are higher than the reference hybrid rope with PP core (P). This could be attributed to the higher modulus of Dyneema® core since the applied load is shared by the steel outer layer and fiber core, and the outer steel layer bears a same load.

Importantly, in bending and fatigue tests, the invention hybrid rope presents super properties.

The invention hybrid rope (D2) is compared with a hybrid rope having a Dyneema® core extruded with PP (table 3 comparative example 1, D1) and reference rope (P in table 3) at a same applied load, i.e. 8.81 tones.

In this case, the SF of hybrid rope having Dyneema® core extruded with Arnitel® (D2) is higher than that of the reference hybrid rope with PP core (P), i.e. 5.9 vs. 5.2. Importantly, the reference hybrid rope with PP core (P) is destructed after about 110.000 cycles, while the hybrid rope having Dyneema® core extruded with Arnitel® (D2) gives about 40% more cycles to destruction, i.e. being broken after about 150.000 cycles.

TABLE 3

Hybrid ropes in comparison.

| | Core of the Hybrid Ropes | Linear Weight (kg/m) | Breaking Load (tons) | Applied Load (tons) | Safety Factor (SF) | Modulus (GPa) |
|---|---|---|---|---|---|---|
| Invention Example (D2) | Dyneema ® core extruded with Arnitel ® | 2.69 | 52.37 | 8.81 | 5.9 | 89.81 |
| Comparative Example 1 (D1) | Dyneema ® core extruded with PP | 2.75 | 52.17 | 8.81 | 5.9 | 87.98 |
| Reference (P) | PP core without extruded layer | 2.75 | 46.07 | 8.81 | 5.2 | 76.00 |

Moreover, the SF of the comparative hybrid rope (D1) (SF=5.9) is also higher than the reference rope (SF=5.2). The elongation and diameter reduction due to bending and fatigue of the comparative hybrid rope (D1) after being in use is less than that of the reference rope, i.e. a hybrid rope without coating on the core (P).

In addition, the invention hybrid rope (D2) shows significantly less elongation and less diameter reduction compared with both the comparative hybrid rope (D1) and reference hybrid rope (P). The diameter reduction is down to 1% for D2, while 2% for D1 and 3% for P. Also, less wire breaks are found in the invention hybrid rope (D2) after being in use for certain cycles.

Ropes Loaded at the same Safety Factor:

In the bending and fatigue tests, the SF of 5 takes account of the cyclic load that the invention and reference hybrid ropes are subjected to, i.e. the actual applied load is ⅕ of the breaking load of the hybrid rope.

TABLE 4

Hybrid ropes in comparison.

| | Core of the Hybrid Ropes | Linear Weight (kg/m) | Breaking Load (tons) | Applied Load (tons) @ SF = 5 | Modulus (GPa) |
|---|---|---|---|---|---|
| Invention Example (D3)* | Dyneema ® core extruded with Arnitel ® | 2.69 | 52.37 | 9.9 | 89.81 |
| Reference (P)* | PP core without extruded layer | 2.75 | 46.07 | 8.81 | 76.00 |

Figure 7:
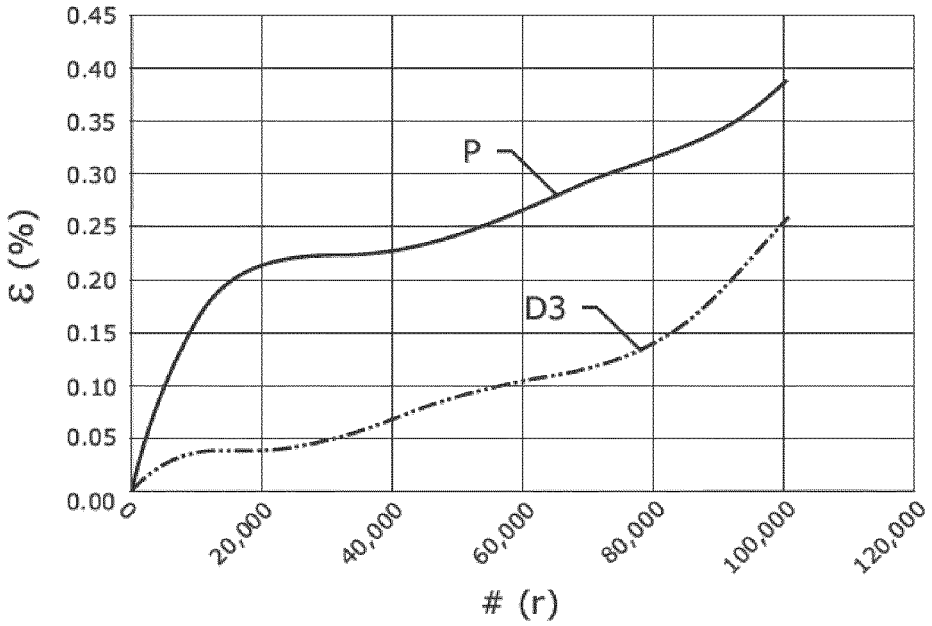
FIG. 7 shows the elongation of an invention hybrid rope and reference hybrid rope vs. cycles in bending fatigue tests.

*Elongations of the hybrid ropes during bending and fatigue test are shown in FIG. 7.

As shown in table 4, at the same safety factor, i.e. SF=5, the applied load on the invention hybrid rope of Dyneema® core extruded with Arnitel® (D3) is 9.9 tons vs. 8.81 tones of the applied load on the reference hybrid rope with PP core (P). Even if about 13% more load is applied on the invention hybrid rope (D3), the invention hybrid rope (D3) shows significantly less elongation after same number of cycles compared with reference rope (P) as shown in FIG. 7. This result is consistent with the measurement of diameter reduction after same number of cycles: Less diameter reduction, which is around 1.3% with the invention hybrid rope (D3), compared with diameter reduction of reference rope (P) which is around 2.9%. The development of elongation and diameter reduction will close the gaps between the metallic or steel wires and enhance their friction/fretting and eventually result in the break of wires. Indeed, the wire breaks earlier and more for the reference hybrid rope than the invention hybrid rope after being in use for certain cycles.

The invention hybrid rope indicates a guaranteed reliability and long life time and thus is suitable for critical applications.

It should be understood that although the present invention has been specifically disclosed by preferred embodiments and optional features, modification and variation of the inventions embodied herein disclosed may be resorted to by those skilled in the art, and that such modifications and variations are considered to be within the scope of this invention.

LIST OF REFERENCES

10 composite cable
12 synthetic core
14 metal jacket
16 wire
20 hybrid rope 1
22 fiber core
23 coated polymer layer
24 outer layer
26 metallic wirelike member
30 hybrid rope 2
32 fiber core
33 extruded copolyester elastomer layer
34 first metallic wirelike member
38 second metallic wirelike member
40 hybrid rope 3
42 fiber core
43 extruded copolyester elastomer layer
44 first metallic wirelike member
45 coated plastomer layer
48 second metallic wirelike member
49 thermoplastic protection layer
50 hybrid rope 4
52 fiber core
53 extruded copolyester elastomer layer
54 outer layer
56 fiber core
57 extruded layer
58 metallic wirelike member
60 hybrid rope
62 fiber core
63 extruded layer
64 outer metallic layer
66 steel strand

The invention claimed is:

1. A hybrid rope comprising a core element containing high modulus fibers surrounded by at least one outer layer containing metallic members, wherein the core element is coated with a polymer comprising a copolyester elastomer containing soft blocks in the range of 10 to 70 wt %.

2. The hybrid rope according to claim 1, wherein a hardness Shore D of the copolyester elastomer as measured according to ISO 868 is larger than 50.

3. The hybrid rope according to claim 1, wherein the copolyester elastomer is a copolyester block copolymer with soft blocks consisting of segments of polyester, polycarbonate, polyether or a combination thereof.

4. The hybrid rope according to claim 1, wherein the high modulus fibers contain high molecular weight polyethylene (HMwPE), ultrahigh molecular weight polyethylene (UHMwPE), liquid crystal polymer (LCP), aramid, or PBO (poly (p-phenylene-2,6-benzobisoxazole).

5. The hybrid rope according to claim 1, wherein the polymer is coated on the core element by extrusion.

6. The hybrid rope according to claim 1, wherein a thickness of the polymer is larger than 0.5 mm.

7. The hybrid rope according to claim 1, wherein the hybrid rope has a diameter in a range of 2 to 400 mm.

8. The hybrid rope according to claim 1, further comprising a jacket surrounding the at least one outer layer, the jacket comprising a plastomer, thermoplastic, elastomer or combination thereof.

9. The hybrid rope according to claim 1, wherein the metallic members are steel wires, steel wire strands or combination thereof.

10. The hybrid rope according to claim 9, wherein the steel wires, the steel wire strands or the combination thereof are coated with zinc, zinc alloy or a combination thereof.

11. The hybrid rope according to claim 1, wherein the at least one outer layer comprises two or more outer layers containing metallic members.

12. The hybrid rope according to claim 1, wherein an additional plastomer layer is added in-between the core element and the polymer.

13. A method of manufacturing a hybrid rope, the method comprises the steps:

(a) providing a core element, wherein the core element includes high modulus fibers;

(b) coating the core element with a polymer comprising copolyester elastomer containing soft blocks in a range of 10 to 70 wt %; and (c) twisting a plurality of metallic members together around the core element to form a metallic outer layer.

14. The hybrid rope according to claim 11, wherein an additional plastomer layer is added in-between the core element and the polymer.

15. The method according to claim 13, wherein the metallic members are steel wires, steel wire strands or combination thereof.

* * * * *